US006095807A

United States Patent [19]

Reyes-Gonzales

[11] Patent Number: 6,095,807

[45] Date of Patent: Aug. 1, 2000

[54] ANTI-SLIDING BAR FOR FURNACE WALL CONSTRUCTIONS

[75] Inventor: Roberto-Aureliano Reyes-Gonzales, Monterrey, Mexico

[73] Assignee: Grupo Nutec S.A. de C.V., Monterrey, Mexico

[21] Appl. No.: 09/165,323

[22] Filed: Oct. 2, 1998

[51] Int. Cl.[7] ..... F27D 1/00

[52] U.S. Cl. ..... 432/247; 110/336; 52/574

[58] Field of Search ..... 432/247, 248; 110/336, 338; 52/506.02, 506.03, 506.08, 574, 579; 266/280, 283, 286

[56] References Cited

U.S. PATENT DOCUMENTS

| | | | |
|---|---|---|---|
| 4,039,280 | 8/1977 | Kienow et al. | 432/248 |
| 4,336,086 | 6/1982 | Rast | 432/248 |
| 4,411,621 | 10/1983 | Miller | 432/247 |
| 4,829,734 | 5/1989 | Schraff | 110/336 |
| 5,664,946 | 9/1997 | Bedi | 433/140 |

*Primary Examiner*—Denise L. Ferensic
*Assistant Examiner*—Gregory A. Wilson
*Attorney, Agent, or Firm*—Abelman, Frayne & Schwab

[57] ABSTRACT

An anti-sliding bar for furnace wall constructions of the type comprising: an open support structure wall and mat means of fibrous insulating material, including U,S,C or the like shaped sections interleaved to each other; anchoring means between the interleaved U,S,C or the like shaped sections, and tying means passing through the mat means, to hold the anchoring means attaching the mat means to the open support structure wall; the anti-sliding bar comprising: a rod supporting the mats, extending horizontally between the U, S,C or the like shaped sections, having: anti-sliding means, fastening tying means for supporting the bar to the mesh means.

7 Claims, 2 Drawing Sheets

ANTI-SLIDING BAR FOR FURNACE WALL CONSTRUCTIONS

BACKGROUND OF THE INVENTION

A. Field of the Invention.

This invention relates to furnace walls and more particularly to an antisliding support bar for furnace wall constructions, which is anchored into a fiber insulation module in order to avoid sliding thereof in spite of temperature changes.

B. Description of the Related Art.

There are well known furnace wall constructions constituted by fiber insulation modules.

Generally, the furnace wall constructions such as those used in shuttle kilns, comprises several insulation modules made from fiber mats retained to a mesh by anchoring means, which in turn is attached to a support structure.

Usually the anchoring means comprises a support bar placed between the fiber insulation modules, which is attached to the mesh by twisted wires or a nut-screw assembly passing through the fiber modules.

A furnace wall construction of the above referred characteristics is disclosed in the U.S. Pat. No. 4,411,621 of Miller, which comprises an expanded sheet metal member and first and second interleaved U-Shaped mats of ceramic fiber insulation material supported thereon. The first ones of the U-shaped mats have the closed ends thereof abutting the corresponding expanded sheet metal member with the legs of each mat extending inwardly of the chamber, and the second ones of the mats have their closed ends facing inwardly of the chamber with the legs of each mat receiving the adjacent legs of an adjacent pair of the first mats therebetween, whereby the closed ends of the second mats extend across the inner ends of the adjacent legs of the first mats. The interleaved mats of insulating material are attached to the corresponding expanded sheet metal member by anchoring means comprising metal rods extending between the legs of the first mats adjacent the closed ends thereof and wire ties fastening the rods to the expanded sheet metal member.

The main disadvantage of the above referred furnace wall, is that the metal rods of the anchoring means have a tendency to slide along the legs of the mats due to the constant heating and cooling, producing a deformation of the anchoring means and furnace walls, mainly because of the continuous dilates and contractions of the metals caused by the temperature changes and consequently, in some cases, the metal rods perforate the external walls of the furnace, damaging the furnace and producing heat loses.

Another furnace wall construction is disclosed in U.S. Pat. No. 5,234,660 of Simko, which discloses: a lightweight ladle cover employing ceramic fiber mats in modules. The modules are formed by having the generally rectilinear mat folded into five adjacent sections, the first of which depends vertically toward the "hot" side of the cover but is sandwiched between the second, third and fourth sections which form a vertical, horizontal ("hot" side) and vertical U-shape configuration about the first section. The last section is folded to extend horizontally to overlay part of the next module. The modules are anchored to an expanded metal wall at the "cold" side of the cover by an anchoring system which employs flat bars having spaced apart threaded studs welded to one flat side of the bar.

Although the anchoring means of the above disclosed furnace wall overcome the above disclosed disadvantages of the sliding anchoring studs disclosed in the U.S. Pat. No. 4,411,621 of Miller, the assembling of the above anchoring system is more complicated because it is necessary to weld the threaded studs to the flat bars, which needs a lot of workmanship and time and create the necessity of acquiring a welding equipment of high energy consumption. Besides, the threaded stud-nut assembly require constants adjustments due to its natural tendency to loosen.

Considering the above referred problems, it was developed an anti-sliding support bar for supporting the fiber insulation modules of a furnace wall construction, having anti-sliding means which overcomes the tendency of the metal rod to slide along the legs of the mats due to the constant heating and cooling and avoids the necessity of including additional elements such as nut-screw assembly welded to the bar.

The anti-sliding bar for furnace wall constructions of the type comprising an open support structure wall and mat means of fibrous insulating material, including U, S or C shaped sections interleaved to each other; anchoring means between the interleaved U-shape sections, and tying means passing through the mat means, to hold the anchoring means attaching the mat means to the open support structure wall; the anti-sliding bar comprises: a rod supporting the mats, extending horizontally between the U, S or C shaped sections, having anti-sliding means, fastening tying means for supporting the bar to the mesh means.

SUMMARY OF THE INVENTION

Is therefore a main objective of the present invention to provide an anti-sliding bar for furnace wall constructions, having anti-sliding means, which overcomes the tendency of the metal rods to slide along the legs of the mats due to the heating and cooling and thus avoiding that the metal rods perforate the external furnace walls.

It is also a main objective of the present invention to provide an anti-sliding bar for furnace wall constructions of the above disclosed nature, which avoids deformation of the furnace wall.

It is another object of the present invention, to provide an anti-sliding bar for furnace wall constructions of the above disclosed nature, which avoid the necessity of including additional elements such as nut-screw assembly welded to the anchoring means.

It is also a main objective of the present invention, to provide an anti-sliding bar for furnace wall constructions of the above disclosed nature, which allows the furnace to have a high heat insulation since there is no deformation of the furnace wall.

These and other objects and advantages of the anti-sliding bar for furnace wall constructions, of the present invention will become apparent to those persons having an ordinary skill in the art, from the following detailed description of the embodiments of the invention which will be made with reference to the accompanying drawings.

DETAILED DESCRIPTION OF THE INVENTION

Figure 1:
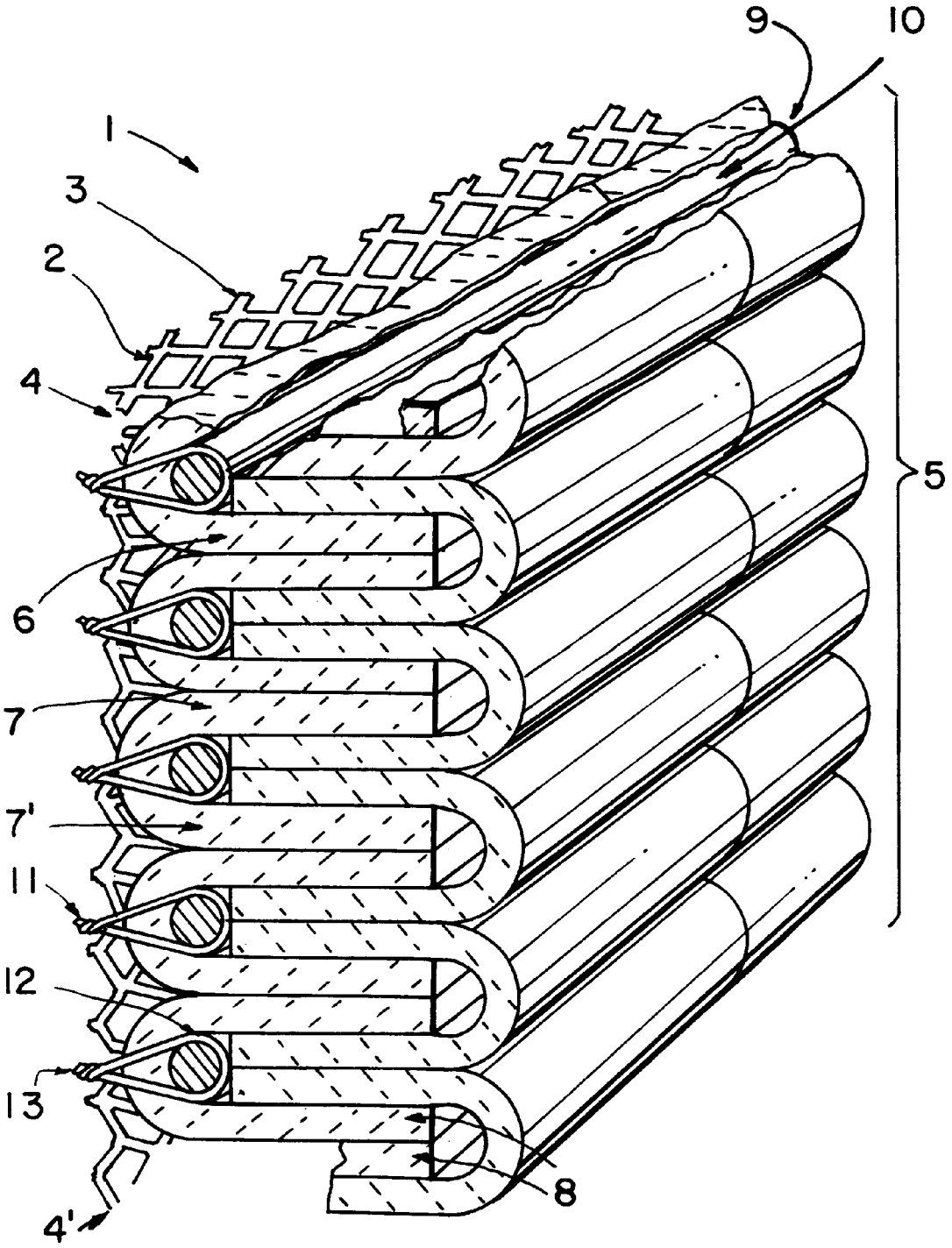
FIG. 1 is an enlarged perspective view of a portion of a furnace wall having the anti-sliding bar of the present invention.
Figure 2A:
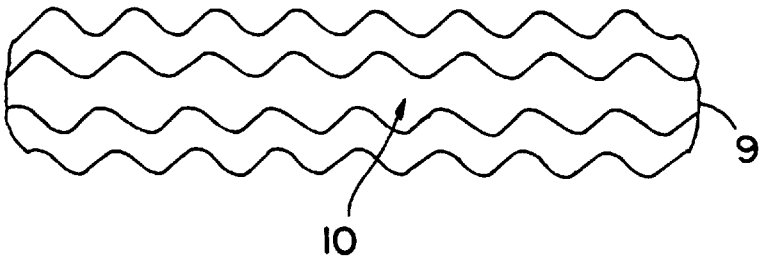
FIG. 2 shows different embodiments of the anti-sliding means of the anti-sliding bar of the present invention.
Figure 2B:
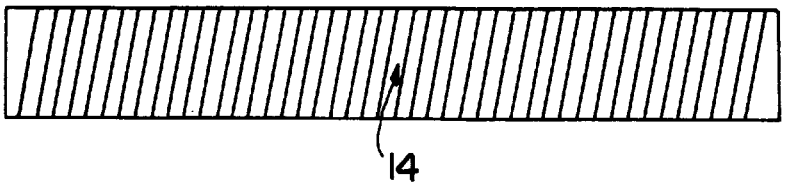
Figure 2C:
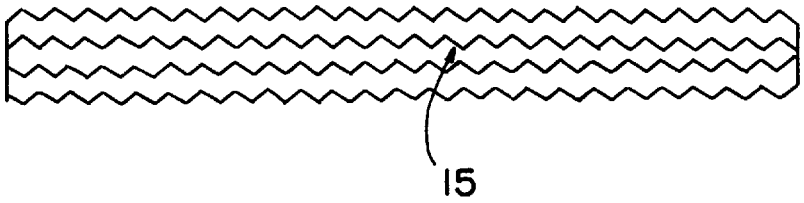
Figure 2D:
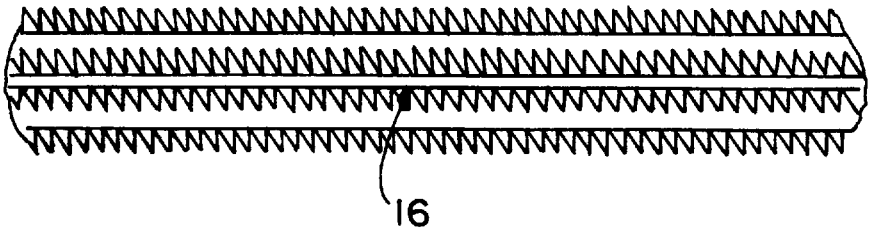
Figure 2E:
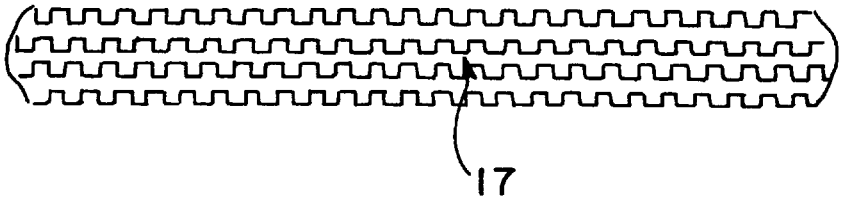

The anti-sliding bar of the present invention for using in anchoring means for furnace wall constructions will now be described, in accordance with a preferred embodiment, said furnace wall construction preferably comprising:

open metal mesh means 1 providing an exposed outer wall surface for a heating chamber and having outer and inner sides 2,3, said metal mesh means 1 having pairs of parallel spaced apart edges 4,4';

mat means of fibrous insulating material 5, covering said inner side 2 of said metal mesh means 1 between said pairs of edges 4,4', said mat means 5, including U, S or C shaped sections 6, having parallel legs 7,7' and an integral bridging portion 8, therebetween, said bridging portions 8, facing said inner side 2 of said metal mesh means 1, and said legs 7,7', extending inwardly from said inner side 2 of said metal mesh means 1, and between one of said pairs of edges 4,4', thereof in parallel relationship with respect to one another;

the anti-sliding bar of the present invention comprising:

a metal rod 9 supporting the interleaved mats 5, extending horizontally between the pair of edges 4,4' of the metal mesh means and between the legs 7,7' of the U, S or C shaped sections adjacent said bridging portion 8, therebetween and having:

anti-sliding means comprising a plurality of undulations 10 extending longitudinally along the metal rod 9, in order to fasten a tie wire 11, having a bight portion 12, extending around the metal rod 9 and outer ends 13, which extend through the mats 5 and mesh means 1, and are twisted together exteriorly of the mesh 1.

The anti-sliding support rods, therefore securely hold the U, S or C shaped mats against the mesh, preventing separation and moving of the insulating material therefrom.

In the same way, the bight portion of the tie wires are held by the undulations of the anti-sliding means of the support rods, preventing the same to slide along the legs of the mats due to the heating and cooling.

Although it has been described that the anti-sliding means of the metal support rod comprises undulations, it can be any kind of anti-sliding means such as opened spirals, 14 serrations 15 or saw teeth 16, and rack like disposition 17.

Furthermore, although it has been said that the anti-sliding bar of the present invention is used in furnace walls like the above described, it can be used in any kind of furnace walls having interleaved U, S or C shaped fiber insulation modules.

Finally it must be understood that the anti-sliding bar for using in anchoring means for furnace wall constructions is not limited exclusively to the embodiments above described and illustrated, and that the persons having ordinary skill in the art would be able, with the teaching provided by the invention, to make modifications to the design and component distribution of the anti-sliding bar for use in anchoring means for furnace wall constructions of the present invention, which will clearly be within of the true inventive concept and of the scope of the invention which is claimed in the following claims:

I claim:

1. An anti-sliding bar for use in anchoring means of furnace wall constructions of the type comprising: an open support structure wall; mat means of fibrous insulating material, including U,S,C or the like shaped sections interleaved to each other; anchoring means comprising a plurality of anti-sliding bars between the interleaved U,S,C or the like shaped sections; and tying means passing through the mat means, to hold the anti-sliding bars attaching the mat means to the open support structure wall; the anti-sliding bar comprising:

a metal rod; and means extending longitudinally along the metal rod for preventing the metal rod and the tying means from sliding with respect to the mat means.

2. The anti-sliding bar for use in anchoring means of furnace wall constructions as claimed in claim 1, wherein the means extending longitudinally along the metal rod comprises undulations.

3. An anti-sliding bar for use in anchoring means of furnace wall constructions of the type comprising: an open support structure wall; mat means of fibrous insulating material, including U,S,C or the like shaped sections interleaved to each other; anchoring means comprising a plurality of anti-sliding bars between the interleaved U,S,C or the like shaped sections; and tying means passing through the mat means, to hold the anti-sliding bars attaching the mat means to the open support structure wall; the anti-sliding bar comprising:

a metal rod; and means extending longitudinally along the metal rod for preventing the metal rod from sliding with respect to the mat means;

wherein the means extending longitudinally along the metal rod comprises opened spirals.

4. An anti-sliding bar for use in anchoring means of furnace wall constructions of the type comprising: an open support structure wall; mat means of fibrous insulating material, including U,S,C or the like shaped sections interleaved to each other; anchoring means comprising a plurality of anti-sliding bars between the interleaved U,S,C or the like shaped sections; and tying means passing through the mat means, to hold the anti-sliding bars attaching the mat means to the open support structure wall; the anti-sliding bar comprising:

a metal rod; and means extending longitudinally along the metal rod for preventing the metal rod from sliding with respect to the mat means;

wherein the means extending longitudinally along the metal rod comprises U-shaped undulations.

5. An anti-sliding bar for use in anchoring means of furnace wall constructions of the type comprising: an open support structure wall; mat means of fibrous insulating material, including U,S,C or the like shaped sections interleaved to each other; anchoring means comprising a plurality of anti-sliding bars between the interleaved U,S,C or the like shaped sections; and tying means passing through the mat means, to hold the anti-sliding bars attaching the mat means to the open support structure wall; the anti-sliding bar comprising:

a metal rod; and means extending longitudinally along the metal rod for preventing the metal rod from sliding with respect to the mat means;

wherein the means extending longitudinally along the metal rod comprises saw teeth.

6. An anti-sliding bar for use in anchoring means of furnace wall constructions of the type comprising: an open support structure wall; mat means of fibrous insulating material, including U,S,C or the like shaped sections interleaved to each other; anchoring means comprising a plurality of anti-sliding bars between the interleaved U,S,C or the like shaped sections; and tying means passing through the mat means, to hold the anti-sliding bars attaching the mat means to the open support structure wall; the anti-sliding bar comprising:

a metal rod; and means extending longitudinally along the metal rod for preventing the metal rod from sliding with respect to the mat means;

wherein the means extending longitudinally along the metal rod comprises serrations.

7. An anti-sliding bar for use in anchoring means of furnace wall constructions of the type comprising: an open support structure wall; mat means of fibrous insulating material, including U,S,C or the like shaped sections interleaved to each other; anchoring means comprising a plurality of anti-sliding bars between the interleaved U,S,C or the like shaped sections; and tying means passing through the mat means, to hold the anti-sliding bars attaching the mat means to the open support structure wall; the anti-sliding bar comprising:

a metal rod; and means extending longitudinally along the metal rod for preventing the metal rod from sliding with respect to the mat means:

wherein the means extending longitudinally along the metal rod comprises rack-like dispositions.

* * * * *